US008269109B2

(12) United States Patent
Hampton et al.

(10) Patent No.: US 8,269,109 B2
(45) Date of Patent: Sep. 18, 2012

(54) FLEXIBLE POWER CABLE WITH IMPROVED WATER TREEING RESISTANCE

(75) Inventors: Robert N Hampton, Peachtree City, GA (US); Ulf Nilsson, Stenungsund (SE); Peter Rydin, Savedalen (SE)

(73) Assignee: Borealis Technology Oy, Porvoo (FI)

( * ) Notice: Subject to any disclaimer, the term of this patent is extended or adjusted under 35 U.S.C. 154(b) by 542 days.

(21) Appl. No.: 12/447,053

(22) PCT Filed: Oct. 26, 2007

(86) PCT No.: PCT/EP2007/009328

§ 371 (c)(1),
(2), (4) Date: Sep. 24, 2009

(87) PCT Pub. No.: WO2008/049636

PCT Pub. Date: May 2, 2008

(65) Prior Publication Data

US 2010/0089611 A1 Apr. 15, 2010

(30) Foreign Application Priority Data

Oct. 27, 2006 (EP) ..... 06022496

(51) Int. Cl.
*H01B 7/00* (2006.01)

(52) U.S. Cl. ..... 174/120 R; 174/120 SC

(58) Field of Classification Search ..... 174/110 R, 174/102 R, 102 SC, 120 R, 120 SC
See application file for complete search history.

(56) References Cited

U.S. PATENT DOCUMENTS

| | | | | |
|---|---|---|---|---|
| 4,767,894 | A * | 8/1988 | Schombourg | 174/106 SC |
| 6,274,239 | B1 * | 8/2001 | Peruzzotti et al. | 428/375 |
| 6,284,374 | B1 * | 9/2001 | Yamazaki et al. | 428/383 |
| 6,423,808 | B1 * | 7/2002 | Watanabe et al. | 526/348.1 |
| 6,524,702 | B1 * | 2/2003 | Betso et al. | 428/379 |
| 6,667,098 | B1 * | 12/2003 | Eklind et al. | 428/380 |
| 7,153,571 | B2 * | 12/2006 | Allermann | 428/391 |
| 2002/0032258 | A1 * | 3/2002 | Tsukada et al. | 524/261 |
| 2004/0024138 | A1 * | 2/2004 | Allermann | 525/342 |
| 2005/0064177 | A1 * | 3/2005 | Lee et al. | 428/323 |
| 2005/0148715 | A1 * | 7/2005 | Caronia et al. | 524/330 |
| 2006/0246286 | A1 * | 11/2006 | Easter | 428/375 |
| 2008/0050588 | A1 * | 2/2008 | Broman et al. | 428/375 |
| 2008/0132657 | A1 * | 6/2008 | Johansson et al. | 526/64 |

FOREIGN PATENT DOCUMENTS

| | | |
|---|---|---|
| GB | 2187589 | 9/1987 |
| WO | 0068957 | 11/2000 |

OTHER PUBLICATIONS

International Search Report dated Dec. 7, 2007 for PCT/EP2007/009328.

International Preliminary Report on Patentability dated Jan. 22, 2009 for PCT/EP2007/009328.

Written Opinion for PCT/EP2007/009328.

* cited by examiner

*Primary Examiner* — William Mayo, III

(74) *Attorney, Agent, or Firm* — Milbank, Tweed, Hadley & McCloy LLP

(57) ABSTRACT

A power cable having a conductor, an inner semiconductive layer, an insulation layer and an outer semiconductive layer, wherein the insulation layer has a polymer having: (i) ethylene monomer units, (ii) polar group containing monomer units, and (iii) silane-group containing monomer units.

17 Claims, No Drawings

FLEXIBLE POWER CABLE WITH IMPROVED WATER TREEING RESISTANCE

This application is based on International Application PCT/EP2007/009328 filed Oct. 26, 2007, which claims priority to European Patent Application No. 06022496.1, filed on Oct. 27, 2006, the disclosures of which are incorporated by reference herein in their entireties.

The present invention relates to a flexible power cable, in particular a medium or high voltage power cable, comprising an insulating layer comprising a polymer composition with improved wet ageing properties, especially improved water treeing resistance properties, and improved crosslinking properties. Furthermore, the invention relates to the use of such a composition for the production of an insulating layer of a power cable.

A typical medium voltage power cable, usually used for voltages from 6 to 36 kV, comprises one or more conductors in a cable core that is surrounded by several layers of polymeric materials, including an inner semiconducting layer, followed by an insulating layer, and then an outer semiconducting layer. These layers are normally crosslinked. To these layers, further layers may be added, such as a metallic tape or wire shield, and finally a jacketing layer. The layers of the cable are based on different types of polymers. Today, crosslinked low density polyethylene is the predominant cable insulating material. Crosslinking can be effected by adding free-radical forming agents like peroxides to the polymeric material prior to or during extrusion, for example cable extrusion.

A limitation of polyolefins for the use as insulating materials is their tendency to be exposed, in the presence of water and under the action of strong electric fields, to the formation of bush-shaped defects, so-called water trees, which can lead to lower breakdown strength and possibly electric failure. Due to the lower electric fields to which low voltage cables are subjected, failure due to water treeing is not an issue for low voltage cables, however, it is an important issue for medium and high voltage cables.

The tendency to water treeing is strongly affected by the presence of inhomogeneities, microcavities and impurities in the material used for the production of the insulation layer. Water treeing is a phenomenon that has been studied carefully since the 1970's.

In electrically strained polymer materials, subjected to the presence of water, processes can occur which are characterized as "water treeing". It is known that insulated cables suffer from shortened service life when installed in an environment where the polymer is exposed to water, e.g. under ground or at locations of high humidity.

The appearance of water tree structures are manifold. In principle, it is possible to differentiate between two types:

"Vented trees" which have their starting point on the surface of the material extending into the insulation material and "Bow-tie trees" which are formed within the insulation material.

The water tree structure constitutes local damage leading to reduced dielectric strength.

Polyethylene is generally used without a filler as an electrical insulation material as it has good dielectric properties, especially high breakdown strength and low power factor. However, polyethylene homopolymers under electrical stress are prone to "water-treeing" in the presence of water.

Many solutions have been proposed for increasing the resistance of insulating materials to degradation by water-treeing. One solution involves the addition of polyethylene glycol, as water-tree growth inhibitor to a low density polyethylene such as described in U.S. Pat. Nos. 4,305,849 and 4,812,505. Furthermore, the invention WO 99/31675 discloses a combination of specific glycerol fatty acid esters and polyethylene glycols as additives to polyethylene for improving water-tree resistance. Addition of free siloxanes such as Vinyl-Tri-Methoxy-Silanes described in EP 449939 is one way to achieve improved water-tree properties. Another solution is presented in WO 85/05216 which describes copolymer blends. However, it is still desirable to improve the water treeing resistance of polyethylene over those prior art materials and/or to improve other properties of the insulating material simultaneously.

Furthermore, the compositions used as insulating material should show good flexibility (measured e.g. in terms of its tensile modulus) so as to facilitate handling and, in particular, installation of the final cable.

Despite the compositions according to the prior art and the resistance to water-treeing that they afford, a solution that could combine water-tree resistance and flexibility is needed.

The object of the present invention is therefore to provide a polymer, in particular polyethylene, composition for use as an insulating material in a medium voltage power cable that offers a combination of improved water tree resistance and improved flexibility over the prior art materials.

Therefore, the present invention provides a power cable comprising a conductor, an inner semiconductive layer, an insulation layer and an outer semiconductive layer, wherein the insulation layer comprises a polymer comprising (i) ethylene monomer units, (ii) a polar-group containing monomer units, and (iii) a silane-group containing monomer units.

It has surprisingly been found that a terpolymer comprising the above-mentioned monomer units inherently shows an improved water tree resistance and, at the same time, also shows improved flexibility, so that this material is especially well suited for the production of an insulating layer of a medium voltage power cable. In particular, following the present invention a medium/high voltage, especially medium voltage, power cable can be provided with a sufficient degree of water treeing resistance without the need of addition of a further water treeing resistance enhancing additive to the polymer composition used for the insulation layer, which cable, at the same time, has improved flexibility.

The expression "polar group containing monomer units" is intended to cover both the case where only one type of polar-groups is present and the case where a two or more different types of polar groups are present. Similarly, the expression "silane-group containing monomer units" is intended to cover both the case where only one type of silane groups is present and the case where a two or more different types of silane groups are present.

Preferably, the polar groups are selected from siloxane, amide, anhydride, carboxylic, carbonyl, hydroxyl, ester and epoxy groups.

The polar groups may for example be introduced into the polymer by grafting of an ethylene polymer with a polar-group containing compound, i.e. by chemical modification of the polyolefin by addition of a polar group containing compound mostly in a radical reaction. Grafting is e.g. described in U.S. Pat. Nos. 3,646,155 and 4,117,195.

It is, however, preferred that said polar groups are introduced into the polymer by copolymerisation of olefinic, including ethylene, monomers with comonomers bearing polar groups.

As examples of comonomers having polar groups may be mentioned the following: (a) vinyl carboxylate esters, such as vinyl acetate and vinyl pivalate, (b) (meth)acrylates, such as methyl(meth)acrylate, ethyl(meth)acrylate, butyl(meth)acrylate and hydroxyethyl(meth)acrylate, (c) olefinically unsaturated carboxylic acids, such as (meth)acrylic acid, maleic acid and fumaric acid, (d) (meth)acrylic acid derivatives, such as (meth)acrylonitrile and (meth)acrylic amide, and (e) vinyl ethers, such as vinyl methyl ether and vinyl phenyl ether.

Amongst these comonomers, vinyl esters of monocarboxylic acids having 1 to 4 carbon atoms, such as vinyl acetate, and (meth)acrylates of alcohols having 1 to 4 carbon atoms, such as methyl (meth)acrylate, are preferred. Especially preferred comonomers are butyl acrylate, ethyl acrylate and methyl acrylate. Two or more such olefinically unsaturated compounds may be used in combination. The term "(meth)acrylic acid" is intended to embrace both acrylic acid and methacrylic acid.

Preferably, the polar group containing monomer units are selected from the group of acrylates.

Furthermore, preferably the polar group containing monomer units are present in the polymer of the insulation layer in an amount of from 2.5 to 15 mol %, more preferably 3 to 10 mol %, and most preferably 3.5 to 6 mol %.

As mentioned the polymer also comprises silane-group containing monomer units. The silane groups may be introduced into the polymer either via grafting, as e.g. described in U.S. Pat. Nos. 3,646,155 and 4,117,195, or, preferably, via copolymerisation of silane groups containing monomers with other monomers, preferably all other monomers, the polymer is consisting of.

In a preferred embodiment of the cable of the invention, the semiconducting layers preferably comprise components (i) and (ii) and carbon black. The amount of carbon black is selected so as to make these layers semiconducting.

Preferably, the inner semiconducting layer is cross-linked with the same type of crosslinking agent as the insulation layer. More preferably, both the outer and the inner semiconducting layer are cross-linked with the same type of crosslinking agent as the insulation layer.

Preferably, the copolymerisation is carried out with an unsaturated silane compound represented by the formula $$R^1SiR^2_qY_{3-q} \quad (I)$$

wherein $R^1$ is an ethylenically unsaturated hydrocarbyl, hydrocarbyloxy or (meth)acryloxy hydrocarbyl group, $R^2$ is an aliphatic saturated hydrocarbyl group, Y which may be the same or different, is a hydrolysable organic group and q is 0, 1 or 2.

Special examples of the unsaturated silane compound are those wherein $R^1$ is vinyl, allyl, isopropenyl, butenyl, cyclohexanyl or gamma-(meth)acryloxy propyl; Y is methoxy, ethoxy, formyloxy, acetoxy, propionyloxy or an alkyl- or arylamino group; and $R^2$, if present, is a methyl, ethyl, propyl, decyl or phenyl group.

A preferred unsaturated silane compound is represented by the formula $$CH_2{=}CHSi(OA)_3 \quad (II)$$

wherein A is a hydrocarbyl group having 1-8 carbon atoms, preferably 1-4 carbon atoms.

Preferably, the silane group containing monomer units are selected from the group of vinyl tri-alkoxy silanes.

The most preferred compounds are vinyl trimethoxysilane, vinyl bismethoxyethoxysilane, vinyl triethoxysilane, gamma-(meth)acryloxypropyltrimethoxysilane, gamma (meth)acryloxypropyltriethoxysilane, and vinyl triacetoxysilane.

In a preferred embodiment, the silane group containing monomer units are present in the polymer of the insulation layer in an amount of from 0.1 to 1.0 mol %.

The copolymerisation of the olefin, e.g. ethylene, and the unsaturated silane compound may be carried out under any suitable conditions resulting in the copolymerisation of the two monomers.

Preferably, the polymer apart from the ethylene monomer units, the polar-group containing monomer units and the silane-group containing monomer units only comprises further alpha-olefin monomer units, such as propylene, 1-butene, 1-hexene or 1-octene. Most preferably, the polymer consists of ethylene monomer units, polar-group containing monomer units and silane-group containing monomer units.

In a preferred embodiment, the polymer of the insulating layer is produced by reactor copolymerisation of monomer units (i), (ii) and (iii).

The polymer used in the insulation layer preferably has a tensile modulus of 100 MPa or less, more preferably 60 MPa or less.

Furthermore, preferably the power cable has an electrical breakdown strength after wet ageing for 1000 hours ($E_b$ (1000)) of at least 48 kV/mm, more preferably at least 50 kV/mm, and still more preferably at least 60 kV/mm.

In a further preferred embodiment, the polymer of the insulation layer is crosslinked after the power cable has been produced e.g. by extrusion Crosslinking might be achieved by all processes known in the art, in particular by incorporating a radical initiator into the polymer composition which after extrusion is decomposed by heating thus effecting crosslinking, or by incorporating a silanol condensation catalyst, which after production of the cable upon intrusion of moisture into the cable links together the hydrolyzed silane groups.

Preferably, the crosslinking agent has been added only to the composition used for the production of the insulation layer before the cable is produced. The crosslinking agent then migrates from the insulation layer into the semiconductive layers during and after production of the power cable.

Furthermore, preferably the semiconductive layers of the cable are fully crosslinked.

Examples for acidic silanol condensation catalysts comprise Lewis acids, inorganic acids such as sulphuric acid and hydrochloric acid, and organic acids such as citric acid, stearic acid, acetric acid, sulphonic acid and alkanoric acids as dodecanoic acid.

Preferred examples for a silanol condensation catalyst are sulphonic acid and tin organic compounds.

Preferably, a Brönsted acid, i.e. a substance which acts as a proton donor, or a precursor thereof, is used as a silanol condensation catalyst.

Such Brönsted acids may comprise inorganic acids such as sulphuric acid and hydrochloric acid, and organic acids such as citric acid, stearic acid, acetic acid, sulphonic acid and alkanoic acids as dodecanoic acid, or a precursor of any of the compounds mentioned.

Preferably, the Brönsted acid is a sulphonic acid, more preferably an organic sulphonic acid.

Still more preferably, the Brönsted acid is an organic sulphonic acid comprising 10 C-atoms or more, more preferably 12 C-atoms or more, and most preferably 14 C-atoms or more, the sulphonic acid further comprising at least one aromatic group which may e.g. be a benzene, naphthalene, phenantrene or anthracene group. In the organic sulphonic acid, one, two or more sulphonic acid groups may be present, and the sulphonic acid group(s) may either be attached to a non-aromatic, or preferably to an aromatic group, of the organic sulphonic acid.

Further preferred, the aromatic organic sulphonic acid comprises the structural element:

$$Ar(SO_3H)_x \quad (II)$$

with Ar being an aryl group which may be substituted or non-substituted, and x being at least 1, preferably being 1 to 4.

The organic aromatic sulphonic acid silanol condensation catalyst may comprise the structural unit according to formula (II) one or several times, e.g. two or three times. For example, two structural units according to formula (II) may be linked to each other via a bridging group such as an alkylene group.

Preferably, Ar is a aryl group which is substituted with at least one $C_4$- to $C_{30}$-hydrocarbyl group, more preferably $C_4$- to $C_{30}$-alkyl group.

Aryl group Ar preferably is a phenyl group, a naphthalene group or an aromatic group comprising three fused rings such as phenantrene and anthracene.

Preferably, in formula (II) x is 1, 2 or 3, and more preferably x is 1 or 2.

Furthermore, preferably the compound used as organic aromatic sulphonic acid silanol condensation catalyst has from 10 to 200 C-atoms, more preferably from 14 to 100 C-atoms.

It is further preferred that Ar is a hydrocarbyl substituted aryl group and the total compound containing 14 to 28 carbon atoms, and still further preferred, the Ar group is a hydrocarbyl substituted benzene or naphthalene ring, the hydrocarbyl radical or radicals containing 8 to 20 carbon atoms in the benzene case and 4 to 18 atoms in the naphthalene case.

It is further preferred that the hydrocarbyl radical is an alkyl substituent having 10 to 18 carbon atoms and still more preferred that the alkyl substituent contains 12 carbon atoms and is selected from dodecyl and tetrapropyl. Due to commercial availability it is most preferred that the aryl group is a benzene substituted group with an alkyl substituent containing 12 carbon atoms.

The currently most preferred compounds are dodecyl benzene sulphonic acid and tetrapropyl benzene sulphonic acid.

The silanol condensation catalyst may also be precursor of the sulphonic acid compound, including all its preferred embodiments mentioned, i.e. a compound that is converted by hydrolysis to such a compound. Such a precursor is for example the acid anhydride of a sulphonic acid compound, or a sulphonic acid that has been provided with a hydrolysable protective group, as e.g. an acetyl group, which can be removed by hydrolysis.

Furthermore, preferred sulphonic acid catalysts are those as described in EP 1 309 631 and EP 1 309 632, namely a) a compound selected from the group of (i) an alkylated naphthalene monosulfonic acid substituted with 1 to 4 alkyl groups wherein each alkyl group is a linear or branched alkyl with 5 to 20 carbons with each alkyl group being the same or different and wherein the total number of carbons in the alkyl groups is in the range of 20 to 80 carbons;

(ii) an arylalkyl sulfonic acid wherein the aryl is phenyl or naphthyl and is substituted with 1 to 4 alkyl groups wherein each alkyl group is a linear or branched alkyl with 5 to 20 carbons with each alkyl group being the same or different and wherein the total number of carbons in the alkyl groups is in the range of 12 to 80;

(iii) a derivative of (i) or (ii) selected from the group consisting of an anhydride, an ester, an acetylate, an epoxy blocked ester and an amine salt thereof which is hydrolysable to the corresponding alkyl naphthalene monosulfonic acid or the arylalkyl sulfonic acid;

(iv) a metal salt of (i) or (ii) wherein the metal ion is selected from the group consisting of copper, aluminium, tin and zinc; and b) a compound selected from the group of (i) an alkylated aryl disulfonic acid selected from the group consisting of the structure:

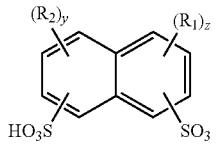

and the structure:

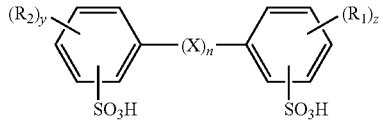

wherein each of $R_1$ and $R_2$ is the same or different and is a linear or branched alkyl group with 6 to 16 carbons, y is 0 to 3, z is 0 to 3 with the proviso that y+z is 1 to 4, n is 0 to 3, X is a divalent moiety selected from the group consisting of —$C(R_3)(R_4)$—, wherein each of $R_3$ and $R_4$ is H or independently a linear or branched alkyl group of 1 to 4 carbons and n is 1; —C(=O)—, wherein n is 1; —S—, wherein n is 1 to 3 and —$S(O)_2$—, wherein n is 1; and (ii) a derivative of (i) selected from the group consisting of the anhydrides, esters, epoxy blocked sulfonic acid esters, acetylates, and amine salts thereof which is a hydrolysable to the alkylated aryl disulfonic acid, together with all preferred embodiments of those sulphonic acids as described in the mentioned European Patents.

However, it is most preferred that crosslinking is achieved by incorporating a radical initiator such as azo component or, preferably, a peroxide, as a crosslinking agent into the polymer composition used for the production of the insulation layer of the power cable. As mentioned, the radical initiator after production of the cable is decomposed by heating, which in turn effects cross-linking.

Hence in a preferred embodiment of the power cable, the polymer has been crosslinked with a radical initiator preferably a peroxide, as a crosslinking agent.

Furthermore, the polymer used for the production of the insulation layer has a $MFR_2$ of 0.1 to 1.5 g/10 min, more preferably 0.5 to 8 g/10 min, and most preferably 1 to 6 g/10 min before crosslinking.

The polymer for the insulation layer can be produced by any conventional polymerisation process.

Preferably, the polymer is a high pressure polymer, i.e. it is produced by radical polymerisation, such as high pressure radical polymerisation. High pressure polymerisation can be effected in a tubular reactor or an autoclave reactor. Preferably, it is a tubular reactor. Further details about high pressure radical polymerisation are given in WO 93/08222, which is herewith incorporated by reference.

In a high pressure process, the polymerisation is generally performed at pressures in the range of 1200 to 3500 bar and at temperatures in the range of 150 to 350° C.

Preferably, the cable or the invention is a so-called "bonded construction", i.e. it is not possible to strip specially designed outer semiconductive materials ("strippable screens") from the crosslinked insulation in a clean manner (i.e. no pick-off) without the use of mechanical stripping tools.

The present invention further relates to a process for the production of a power cable comprising a conductor, an inner semiconductive layer, an insulation layer and an outer semi conductive layer, wherein the insulation layer comprises a polymer comprising (i) ethylene monomer units (ii) polar-group containing monomer units, and (iii) silane-group containing monomer units by extruding the layers onto the conductor.

Preferred embodiments of the process pertain to the production of the power cable in any of the above described preferred embodiments.

Furthermore, preferably in the process for the production of the preferred embodiment of a crosslinked power cable, a crosslinking agent is added to the composition used for the production of the insulation layer before extrusion of the layers, and crosslinking of the layers is effected after extrusion of the cable.

More preferably, the crosslinking agent before extrusion is added only to the composition used for the production of the insulation layer, and the crosslinking of the adjacent semiconductive layers is effected by migration of the crosslinking agent from the insulation layer after extrusion.

Preferably, the process for production of the power cable comprises a step where the extruded cable is treated under crosslinking conditions.

More preferably, crosslinking is effected so that the semiconducting layers are fully crosslinked.

The present invention further relates to a polymer composition which comprises (A) a polymer comprising (i) ethylene monomer units (ii) polar-group containing monomer units, and (iii) silane-group containing monomer units, and (B) a radical initiator as a crosslinking agent, which is particularly suited for the construction of the insulation layer of a power cable comprising a conductor, an inner semiconductive layer, an insulation layer and an outer semiconductive layer with enhanced water treeing resistance and flexibility.

Still further, the invention relates to the use of a polymer comprising (i) ethylene (ii) polar group containing, and (iii) silane group containing monomer units for the production of an insulation, layer of a power cable comprising a conductor, an inner semiconductive layer, an insulation layer and an outer semiconductive layer.

EXPERIMENTAL AND EXAMPLES

1. Definitions and Measurement Methods a) Melt Flow Rate

The melt flow rate (MFR) is determined according to ISO 1133 and is indicated in g/10 min. The MFR is an indication of the flowability, and hence the processability, of the polymer. The higher the melt flow rate, the lower the viscosity of the polymer. The MFR is determined at 190° C. and may be determined at different loadings such as 2.16 kg ($MFR_2$), 5 kg ($MFR_5$) or 21.6 kg ($MFR_{21}$).

b) Flexibility

As a measure for the flexibility of a cable, two test methods have been applied. In both methods, a 20 kV cable with the following construction has been used:

Aluminium core: 7 threads, total diameter: 8.05 mm,

Inner semiconductive layer: thickness: 0.9 mm,

Insulation layer: thickness: 5.5 mm,

Outer semiconductive layer: thickness: 1.0 mm.

Flexibility Test Method A:

A cable sample of a length of 1.0 m is put in a holder (metal pipe). The holder covers 40 cm of the cable and the rest is of the cable (60 cm) is hanging free. The vertical position of the free cable end is now measured. Then, a weight of 1 kg is connected to the end of the cable and the force is slowly added. After 2 min, once again the vertical position of the free cable end is measured. The difference between the two measured vertical positions gives a value of the flexibility of the cable. A big value reflects high flexibility.

Flexibility Test Method B:

The test method is based on ISO178:1993.

The cable is put on two supports with a distance of 200 mm. A load cell is applied on the middle of the cable with a speed of 2 mm/min. The force needed to bend the cable is measured and the tensile modulus (E-modulus) is calculated.

c) Water Treeing Resistance

The water treeing resistance was tested in a wet ageing test as described in the article by Land H. G. & Schädlich H., "Model Cable Test for Evaluating the Ageing Behaviour under Water Influence of Compounds for Medium Voltage Cables", Conference Proceedings of Jicable 91, Jun. 24 to 28, 1991, Versailles, France.

The wet ageing properties were evaluated on (model cables) minicables. These cables consist of a Cu wire onto which an inner semiconductive layer, an insulation layer and an outer semiconductive layer are applied. The cables are extruded and vulcanized, i.e. the material is crosslinked.

The minicable has the following construction: inner semiconductive layer of 0.7 mm, insulation layer of 1.5 mm and outer semiconductive layer of 0.15 mm. The cables are prepared and aged as described below.

| | |
|---|---|
| Preconditioning: | 80° C., 72 h |
| Applied voltage: | 9 kV, 50 Hz |
| Electrical stress (max): | 9 kV/mm |
| Electrical stress (mean): | 6 kV/mm |
| Conductor temperature: | 85° C. |
| Water bath temperature: | 70° C. |
| Ageing time: | 1000 h |

Deionized water in conductor and outside if not otherwise stated.

Five specimens with 0.50 m active length from each cable were aged.

The specimens were subjected to AC breakdown tests (voltage ramp: 100 kV/min) and the Weibull 63.2% values were determined before and after ageing.

The Cu wire in the minicable is removed after extrusion and replaced by a thinner Cu wire. The cables are put into the water bath under electrical stress and at a temperature of 70° C. for 1000 h. The initial breakdown strength as well as the breakdown strength after 1000 h wet ageing are determined.

d) Tensile Modulus

The Tensile Modulus have been measured according to ISO 527-2. Preconditioned specimen "dog bones" are evaluated in a measurement device with an extensiometer and a load cell. Calculation of the material properties are based on manually measured dimensions of the specimen and the results from the extensiometer and loadcell.

2. Tested Cables and Results

For testing the water treeing resistance, model cable samples have been produced with the polymer compositions listed in Table 1:

TABLE 1

| Cable | Semiconductive Layers | Insulation Layer Polymer | Insulation Layer Crosslinking agent |
|---|---|---|---|
| 1 | Blend of a) Ethylene terpolymer with a content of 1300 micromoles of butylacrylate and 120 micromoles of vinyl trimethoxy silane, produced in high pressure process, $MFR_2$ = 5 g/10 min, d = 927 kg/m$^3$ and b) Ethylene homopolymer, $MFR_2$ = 2 g/10 min, density = 922 kg/m$^3$, Ratio a/b = 2; comprising 30 wt % carbon black and 1 wt. % of a polyquinoline type of antioxidant. | Ethylene terpolymer with a content of 1300 micromoles of butylacrylate and 120 micromoles of vinyl trimethoxy silane, produced in high pressure process, $MFR_2$ = 5 g/10 min, d = 927 kg/m$^3$, tensile modulus: 31 MPa. Comprising 0.2 wt % phenolic antioxidant. | 5 wt. % of master batch containing poly(ethylene-co-butylacrylate) and 30 micromoles of dibutyltindilaurate |
| 2 | Poly(ethylene-co-butylacrylate) with a content of 1300 micromoles of butylacrylate, produced in high pressure process, $MFR_2$ = 7 g/10 min Comprising 40 wt % carbon black, 1 wt % of a polyquinoline type of antioxidant, 1 wt % of a peroxide as crosslinking agent. | Same as for cable 1 | 2 wt. % dicumylperoxide |
| 3 | Same as for cable 1 | Same as for cable 1 | 5 wt. % of master batch containing poly(ethylene-co-butylacrylate) and 60 micromoles of dodecyl benzene sulphonic acid |
| 4 (Comp.) | Same as for cable 2 | Ethylene homopolymer, $MFR_2$ = 2.0 g/10 min, d = 922 kg/m$^3$, tensile modulus: 200 MPa | Same as for cable 2 |

The tested cables gave the results as contained in Table 2:

TABLE 2

| | $E_b$(0 h) | $E_b$(1000 h) |
|---|---|---|
| Cable 1 | | 77.6 kV/mm |
| Cable 2 | 96.7 kV/mm | 68.9 kV/mm |
| Cable 3 | 74.9 kV/mm | 49.0 kV/mm |
| Cable 4 (Comp.) | 89 kV/mm | 41 kV/mm |

The results of Table 2 show that the cables according to the invention retain an excellent electrical breakdown strength after ageing which indicates a high water treeing resistance. For comparison, usually an $E_b$(1000 h) of 45 kV/mm is seen as a good result for a medium power cable.

Furthermore, for testing the flexibility three further cables (one according to the invention and two comparative) were produced with the polymer compositions listed in Table 3:

TABLE 3

| Cable | Semicond. Layers | Insulation Layer Polymer | Insulation Layer Crosslinking agent |
|---|---|---|---|
| 5 | Same as for cable 2 in table 1 | Same as for cable 1 in table 1 | Same as for cable 2 in table 1 |
| 4 (Comp.) | Same as for cable 2 in table 1 | Same as for cable 4 in table 1. | Same as cable 2 in table 1 |
| 6 | Same as for cable | Poly(ethylen-co- | Same as for cable 1 |

TABLE 3-continued

| Cable | Semicond. Layers | Insulation Layer Polymer | Crosslinking agent |
|---|---|---|---|
| (Comp.) | 1 in table 1 | vinyltrimethoxy silane)with a content of 120 micromole vinyl trimethoxy silane, produced in high pressure process, $MFR_2$ = 2 g/10 min, d = 922 kg/m$^3$, comprising 0.2 wt % phenolic antioxidant. | in table 1. |

The flexibility tests yielded the results as shown in Table 4:

TABLE 4

| Cable | Test method A Initial end position | End Position after 2 min. | Difference | Test method B E-modulus/ MPa |
|---|---|---|---|---|
| 5 | 99 | 55 | 44 | 220 |
| 4 (Comp.) | 99 | 63 | 36 | 311 |
| 6 (Comp.) | 99 | 61 | 38 | 259 |

It can be seen from the results given in Table 4 that the cable according to the invention has an enhanced flexibility in both test methods A and B.

The invention claimed is:

1. A power cable comprising a conductor, an inner semiconductive layer, an insulation layer and an outer semiconductive layer, made by extruding the layers onto the conductor, wherein the insulation layer comprises a polymer comprising:

(i) ethylene monomer units, (ii) polar-group containing monomer units, and (iii) silane-group containing monomer units;

wherein the power cable has an electrical breakdown strength after wet ageing for 1000 hours ($E_b$ (1000)) of at least 48 kV/mm; and wherein the polymer has been crosslinked with a radical initiator as a crosslinking agent.

2. The power cable according to claim 1, wherein the polymer has a tensile modulus of 100 MPa or less.

3. The power cable according to claim 1, wherein the crosslinking agent has been added only to the composition used for the production of the insulation layer before the cable is produced.

4. The power cable according to claim 1 wherein the semiconductive layers are fully crosslinked.

5. The power cable according to claim 1 wherein the polar group containing monomer units are present in the polymer in an amount of from 2.5 to 15 mol %.

6. The power cable according to claim 1 wherein the silane group containing monomer units are present in the polymer in an amount of from 0.1 to 1.0 mol %.

7. The power cable according to claim 1 wherein the polar group containing monomer units are selected from the group of acrylates.

8. The power cable according to claim 1 wherein the silane group containing monomer units are selected from the group of vinyl tri-alkoxy silanes.

9. The power cable according to claim 1 wherein the polymer has a $MFR_2$ of 0.1 to 15 g/10min.

10. The power cable according to claim 1 wherein the polymer is a high pressure polyethylene.

11. The power cable according to claim 1 wherein the polymer is produced by reactor copolymerisation of monomer units (i), (ii) and (iii).

12. The power cable according to claim 1, wherein the radical initiator is a peroxide.

13. A process for the production of a power cable comprising a conductor, an inner semiconductive layer, an insulation layer and an outer semiconductive layer, wherein the insulation layer comprises a polymer comprising:

(i) ethylene monomer units, (ii) polar-group containing monomer units, and (iii) silane-group containing monomer units;

wherein the power cable has an electrical breakdown strength after wet ageing for 1000 hours ($E_b$ (1000)) of at least 48 kV/mm; and wherein the polymer has been crosslinked with a radical initiator as a crosslinking agent;

which process comprises extruding the layers onto the conductor.

14. The process according to claim 13 wherein the power cable produced is crosslinked, a crosslinking agent is added to the composition used for the production of the insulation layer before extrusion of the layers, and crosslinking of the layers is effected after extrusion of the cable.

15. The process according to claim 14 wherein the crosslinking agent before extrusion is added only to the composition used for the production of the insulation layer, and the crosslinking of the adjacent semiconductive layers is effected by migration of the crosslinking agent from the insulation layer after extrusion.

16. The process according to claim 14, wherein the process comprises a step where the extruded cable is treated under crosslinking conditions.

17. The process according to claim 16 wherein crosslinking is effected so that the semiconducting layers are fully crosslinked.

* * * * *